United States Patent [19]

Perdue

[11] 3,950,919

[45] Apr. 20, 1976

[54] APPARATUS AND PROCESS FOR VACUUM SKIN PACKAGING

[75] Inventor: Richard Russell Perdue, Greer, S.C.

[73] Assignee: W. R. Grace & Co., Duncan, S.C.

[22] Filed: Aug. 22, 1974

[21] Appl. No.: 499,701

[52] U.S. Cl. ..... 53/22 A; 53/112 A

[51] Int. Cl.[2] ..... B65B 31/02

[58] Field of Search ..... 53/22 A, 112 A

[56] References Cited

UNITED STATES PATENTS

| | | | |
|---|---|---|---|
| 2,991,600 | 7/1961 | Lancaster | 53/112 A X |
| 3,195,288 | 7/1965 | Sloan et al. | 53/112 A X |
| 3,597,899 | 8/1971 | Hanson | 53/112 A X |
| 3,694,991 | 10/1972 | Perdue et al. | 53/22 A |

*Primary Examiner*—Travis S. McGehee

*Attorney, Agent, or Firm*—John J. Toney; William D. Lee, Jr.; Richard G. Jackson

[57] ABSTRACT

The invention disclosed is directed to a new improved apparatus for vacuum skin packaging an article between two flexible web layers. The apparatus includes two molds, each having an inner wall defining a generally concave open cavity and terminating to a lip about the cavity opening, means for receiving and releasing web layers in wall-conforming shape, means for releasably receiving outer portions of the web layers adjacent the lips, means for registering the molds to provide a partially enclosed third cavity, and means for reducing pressure substantially throughout the third cavity by removing gaseous composition therefrom through a passageway means provided by portions of the lips which are spaced apart when the molds are in packaging register. Also disclosed is a process for vacuum skin packaging. If desired, the process may be performed using the apparatus.

24 Claims, 13 Drawing Figures

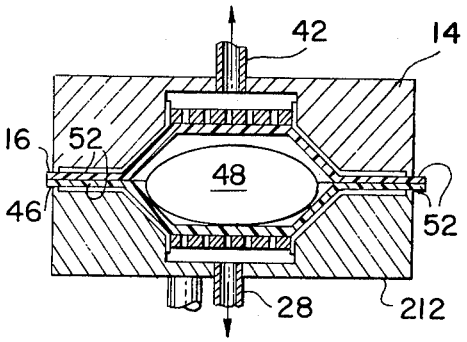
FIG. 4
FIG. 5
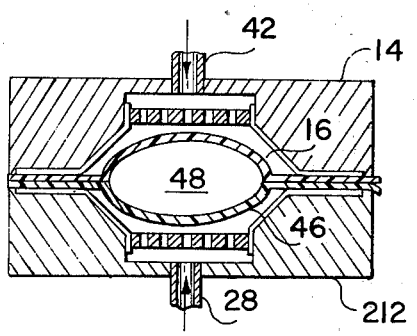
FIG. 6
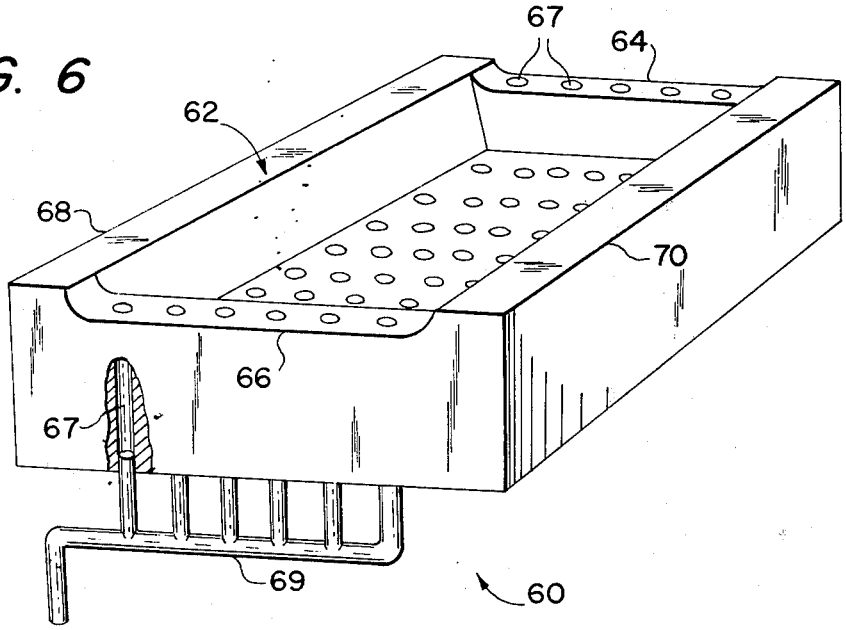

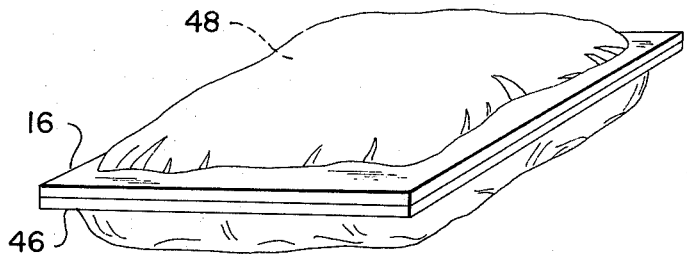
FIG. 7
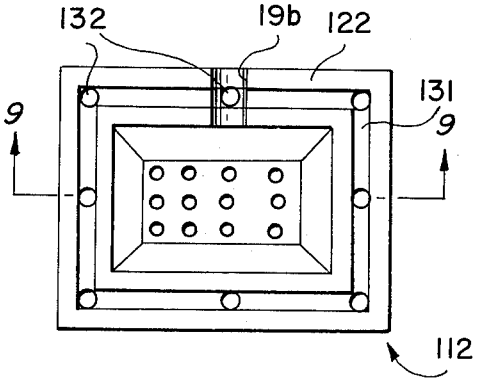
FIG. 8
FIG. 9
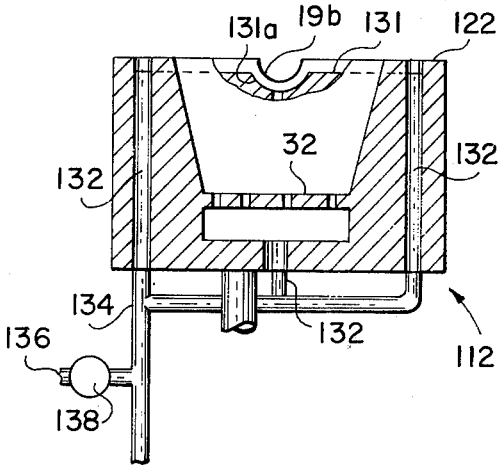
FIG. 10
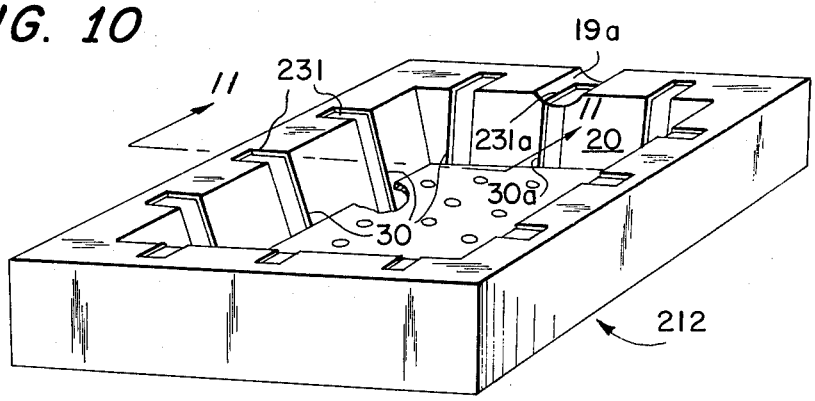

APPARATUS AND PROCESS FOR VACUUM SKIN PACKAGING

This invention relates to an improved process and apparatus for skin packaging products under subatmospheric pressure.

Numerous processes and apparatuses for skin packaging under subatmospheric pressure are described in the patent literature, wherein such packaging is typically referred to as vacuum skin packaging. U.S. Pat. No. 3,491,504 to Young, Pasco, and Wolfelsperger discloses a method and apparatus for skin packaging wherein a product supported on a lower film, in turn supported on a reciprocably movable substantially flat lower platen, and disposed within a hermetically sealed and evacuated chamber is pushed into a relatively flat softened upper film. In U.S. Pat. No. 3,634,993 to Pasco and Wolfelsperger, and assigned to Young, it is stated that "this lower film is usually supported by a substantially flat lower or bottom platen which makes it difficult if not impossible to satisfactorily package the product when it is desired to tightly form this bottom film member to the product. With frozen meat this difficulty often occurs in the disclosed apparatus as shown and described in the above [cited] patent." The latter cited patent discloses a skin packaging apparatus having a flat bottom platen reciprocably movable within a vacuum chamber, a skin package including upper and lower films which are conformed to the shape of the packaged product and joined in heat-sealed condition peripherally of the mid-height thereof, and a skin packaging process wherein the product is pushed into the upper film.

U.S. Pat. No. 3,686,822, issued to Wolfelsperger on Aug. 29, 1972 discloses a skin package wherein upper and lower films are conformed to the shape of the packaged product and heat sealed peripherally of a mid-height thereof and a method and apparatus for skin packaging. In the latter method, briefly stated, outer portions of upper and lower films are spaced apart throughout and clamped between a ring-type chamber form disposed intermediate the films and generally flat upper and lower platens, respectively. The films are pushed towards each other by differential pressure to stretch the films over a product disposed within the chamber and spaced from the inner sides thereof. Warmed portions of the films are heat sealed together and outer portions of the films are drawn into engagement with the inner sides of the chamber form. U.S. Pat. No. 3,736,721 issued to Wolfelsperger on Jun. 5, 1973 describes a method and apparatus for forming a skin package from a single heat-sealable thermoplastic film using a chamber formed of a pair of U-shaped members disposed at right angles to each other.

The methods and apparatuses of the above cited patents have not been entirely satisfactory for reasons including complexity, excessive film requirements, undesirable film wrinkling, excessive and non-uniform thinning of the films, and limitations on size of packaged products relative to the chamber size.

Briefly stated, U.S. Pat. No. 3,694,991, issued to Perdue et al. on Oct. 3, 1972, discloses an effective process of forming a vacuum skin package including a film partially about a product supported by a gas impervious member illustrated as an impervious backing board and an apparatus including a vacuum chamber having an open top which may be used in performing the process.

Succinctly stated, U.S. Pat. No. 3,754,372, issued to Perdue on Aug. 28, 1973, discloses an evacuated package having at least one semi-rigid distinct portion and a process and apparatus for producing the package.

U.S. Pat. No. 3,545,163 issued to Mahaffey et al., discloses a three station packaging machine for applying a flexible film to a semi-rigid cup-like receptacle. In operation the machine evacuates a nearly completed package through a slit cut in the cup material and, thereafter the slit is sealed, followed by venting the evacuation chamber to atmosphere.

U.S. Pat. No. 3,706,174 issued to Young et al. on Dec. 19, 1972 discloses a machine and method for evacuating sealed packages through a pierced opening and resealing.

U.S. Pat. No. 3,242,245 to Greig et al. discloses a molding process and apparatus for forming hollow plastic structures, such as panel structures and hot air conduits, having self-supporting rigidity. The structures are formed by fusing plastic sheets together along a boundary line and held apart within the fused boundary by bridging connections between the sheets.

French Pat. Nos. 1,258,357 (Mar. 6, 1961) and 1,286,018 (Jan. 22, 1962) to Bresson and Australian Pat. No. 245,774 (Jul. 16, 1973) disclose vacuum skin packaging processes using backing boards. These patents are summarized in above-cited U.S. Pat. No. 3,694,991.

U.S. Pat. No. 3,538,670 to Morgan discloses an apparatus having two arbors for forming sealed articles.

It has now been found that articles may be vacuum skin packaged between layers of flexible web material in a simple, efficient and better manner using the improved process and apparatus of the present invention. Substantial improvements over heretofore known vacuum skin packaging processes and apparatus are provided by this invention without detracting from the effective utility thereof. Vacuum skin packages including opposed film layers effectively conformed to packaged articles may thus be prepared with minimum film thinning, more uniform film stretching, and less film wrinkling, while at the same time not only using less film and not requiring a slit in the film, but also permitting packaging of larger articles relative to the size of a chamber wherein packaging may be effected. A wide variety of materials, articles, and products including, but not limited to, frozen or non-frozen meat, poultry and fish, may be effectively skin packaged between two flexible web layers with substantial ease using the present invention.

Generally stated, the packaging apparatus of the present invention includes two molds, each having an inner wall defining a generally concave open cavity and terminating to a lip about the cavity opening, means for releasably receiving web layers in wall-conforming shape, means for releasably receiving outer portions of the web layers adjacent the lips, means for registering the molds to provide a partially enclosed third cavity, and means for reducing pressure substantially throughout the third cavity by removing gaseous composition therefrom through a passageway means provided by portions of the lips which are spaced apart when the molds are in packaging register.

In an aspect of this invention the packaging apparatus includes a. a first mold having a first inner wall defining a first generally concave open cavity, said first wall terminating to a first lip disposed peripherally about the opening of said first cavity, said first wall adapted to receive an inner portion of a first layer of flexible web material;

b. means for releasably receiving the inner portion of the first web layer adjacent the first wall in generally wall-conforming shape substantially throughout the cavity-defining surface thereof and for releasing the received portion of the first layer;

c. a second mold having a second inner wall defining a second generally concave open cavity, said second wall terminating to a second lip disposed peripherally about the opening of said second cavity, said second wall adapted to receive an inner portion of a second layer of flexible web material;

d. means for releasably receiving the inner portion of the second web layer adjacent the second wall in generally wall-conforming shape substantially throughout the cavity-defining surface thereof and for releasing the received portion of the second web layer;

e. means for releasably receiving a relatively outer portion of the first web layer adjacent the first lip;

f. means for releasably receiving a relatively outer portion of the second web layer adjacent the second lip;

g. means for substantially registering the molds to provide a partially enclosed third cavity for forming a package; and h. means for reducing pressure substantially throughout the third cavity by removing gaseous composition therefrom through a passageway means provided by spaced apart portions of said first and second lips when the molds are in register, said passageway means extending from inner ends of said lips to outer ends of said lips, at least one of said inner walls adapted to support an article to be packaged and placed on a film received adjacent said at least one inner wall.

In a preferred aspect of this invention, the passageway means of the apparatus set forth above extends substantially about the openings of the first and second cavities.

In another preferred aspect, the first and second lips of the apparatus are cooperable in register position for substantially hermetically sealing flange portions of first and second web layers between first corresponding regions of the lips and the passageway means is provided by second corresponding spaced apart regions of the lips. In this aspect the cavity openings or mouth may be generally polygonal, generally rectangular for example, and the passageway means may include passages terminating to a pair of generally opposite sides of the polygon. The passageway means may include a recess in at least one of the lips. In this aspect, the apparatus is highly suitable for preparing a plurality of severable skin package units from opposed web layers which may be advanced in generally parallel relation each to the other from the same or different supply rolls. The apparatus is preferably disposed relative to the direction of web advance so that, when portions of the mold received webs are in packaging register, opposite sides of the webs are received adjacent the second corresponding spaced apart lip regions which provide the passageway means and the webs are substantially hermetically sealed each to the other in generally forward and generally rearward portions thereof.

In a preferred aspect of this invention, the apparatus is adapted for packaging an article between first and second layers of flexible thermoformable web material. In this aspect the first and second walls of the above-described apparatus are each adapted to receive a layer of flexible thermoformable web material, and the apparatus further includes means for heating at least the inner surfaces of the first and second cavities.

In another preferred aspect of this invention, each receiving and releasing means set forth in clauses (b) and (d) above includes means for developing differential fluid pressure across the inner portion of the corresponding web layer to effect the receiving and releasing functions.

In another preferred aspect of this invention, the means for releasably receiving the relatively outer portion of the first web layer includes differential pressure means communicating with the receiving and releasing means associated with the first cavity and the means for releasably receiving the relatively outer portion of the second web layer includes differential pressure means communicating with the receiving and releasing means associated with the second cavity.

Generally stated, the present process for vacuum skin packaging an article between two flexible web layers includes providing an arrangement of an article within a partially enclosed cavity defined by two opposite flexible web layers having generally concave opposed inner portions with portions of the layers disposed peripherally of the inner portions in spaced adjacent relation to define a passageway, drawing a vacuum in the cavity intermediate the layers, and collapsing inner portions of the layers about the article and outer portions into sealed layer-to-layer engagement.

In an aspect of the present invention, the packaging process includes

A. providing a first layer of flexible web material having a first substantially concave-shape inner portion with a peripheral portion of said first layer disposed outwardly of said first inner portion;

B. providing a second layer of flexible web material having a second substantially concave-shape inner portion with a peripheral portion of said second layer disposed outwardly of said second inner portion;

each layer of web material preferably having low permeability to gaseous compositions and adapted to bond to the other layer to form a hermetic seal;

C. placing the article on the substantially concave surface of at least one of said web layers;

D. registering said concave-shape web layers to provide a partially enclosed packaging cavity about the article with at least a portion of the outwardly disposed portion of one of the web layers spaced from the other web layer to define a passageway means extending from the cavity to a periphery of at least one of the webs;

E. while maintaining the web layers in registered relation, removing a sufficient portion of gaseous composition from the packaging cavity through the passageway means to reduce the gas pressure in the cavity to below atmospheric pressure;

F. while the pressure in the packaging cavity is reduced, moving the web layers to collapse first portions of the layers into substantially conforming relation with the overall periphery of the article and to collapse second portions of the layers into layer-to-layer engagement peripherally of the article; and G. bonding said engaged web portions to form a hermetically sealed packaged article.

Thus the present process for vacuum skin packaging an article between two flexible web layers may include A. receiving an inner portion of a first layer of flexible web material into substantially conforming relation with a first concave surface and receiving a portion of said layer disposed outwardly of said inner portion into substantially conforming relation with a first lip surface disposed peripherally of said first concave surface;

B. receiving an inner portion of a second layer of flexible web material into substantially conforming relation with a second concave surface and receiving a portion of said second layer disposed peripherally of said inner portion into substantially conforming relation with a second lip surface disposed peripherally of said second concave surface;

each layer of web material preferably having low permeability to gaseous compositions and adapted to bond to the other layer to form a hermetic seal;

C. placing the article on the substantially concave surface of at least one of said received web layers;

D. registering the received web layers to provide a partially enclosed packaging cavity about the article with at least portions of the received outwardly disposed web portions being spaced apart to define a passageway means extending from the cavity to a periphery of at least one of the webs;

E. while maintaining the web layers in registered relation removing a sufficient portion of gaseous composition from the packaging cavity through the passageway means to reduce the gas pressure in the cavity to below atmospheric pressure;

F. while the pressure in the packaging cavity is reduced, releasing the received web layers to collapse first portions of the layers into substantially conforming relation with the overall periphery of the article and to collapse second portions of the layers into layer-to-layer engagement peripherally of the article; and G. bonding said engaged web portions to form a hermetically sealed packaged article.

The inner portions of the flexible web layers may be drawn by differential gas pressure into substantially conforming relation with the corresponding concave surfaces.

If desired, the present process may be performed using the present apparatus.

As used herein "low permeability to gaseous compositions" means that the material or member thus characterized is sufficiently resistant to permeation such that subatmospheric pressure within packages including a sheet or film of the material as an enclosing member is substantially maintained for extended periods in gaseous environments normally encountered in storing and handling the packages. Typically, the gaseous environment is air at a pressure from about 740 to 780 mm. Hg. absolute and at a temperature from about 0° F. to about 120° F.

Practice of the present invention will be made more fully apparent by the following detailed description taken with the accompanying drawing wherein like numerals refer to similar elements throughout the several views.

In the drawing:

FIG. 4 illustrates another transverse section of the apparatus taken generally perpendicularly to FIG. 3;

Figure 11:
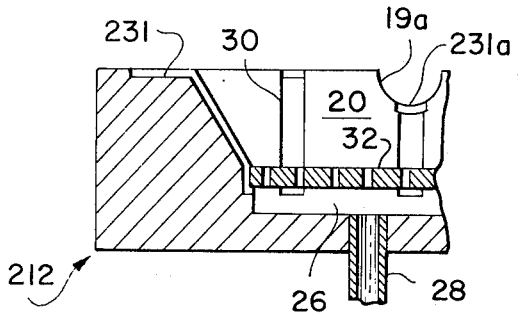
Figure 12:
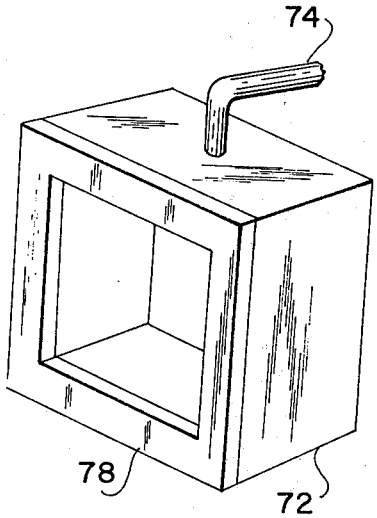
Figure 13:
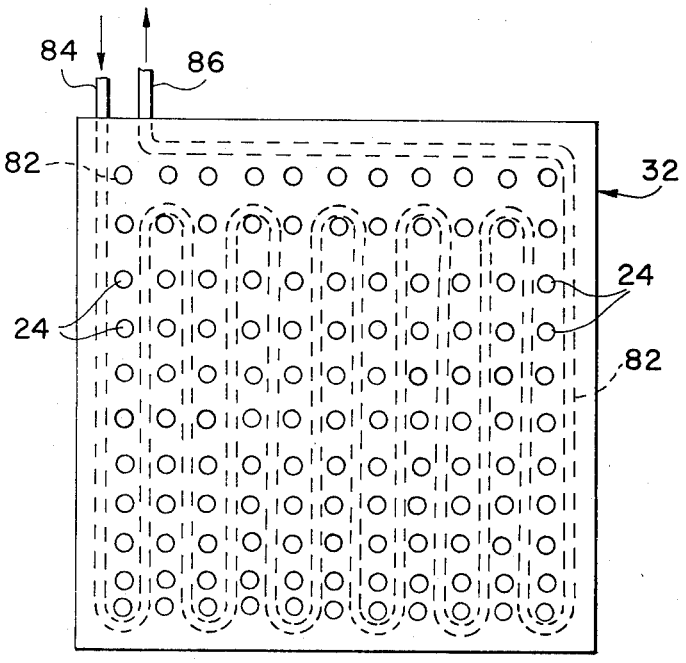

FIG. 5 schematically illustrates operation of the apparatus in collapsing two web layers into substantial conformity with an article and into layer-to-layer engagement peripherally thereof;

FIG. 6 is a partial perspective view of another embodiment mold component of the apparatus;

FIG. 7 is a perspective view of a skin package which may be made using the present apparatus;

FIG. 8 is a plan view of a mold component of another embodiment of the present apparatus;

FIG. 9 is a section taken along line 9—9 of FIG. 8;

FIG. 10 is a perspective view of another embodiment mold component of the present apparatus;

FIG. 11 is an elevation section taken along line 11—11 of FIG. 10;

FIG. 12 is a perspective view illustrating a chamber device which may be used in combination with the present apparatus for reducing the pressure within a packaging cavity formed in operation thereof; and FIG. 13 is a plan view of a heater which may be included as a component of the molds.

Figure 1:
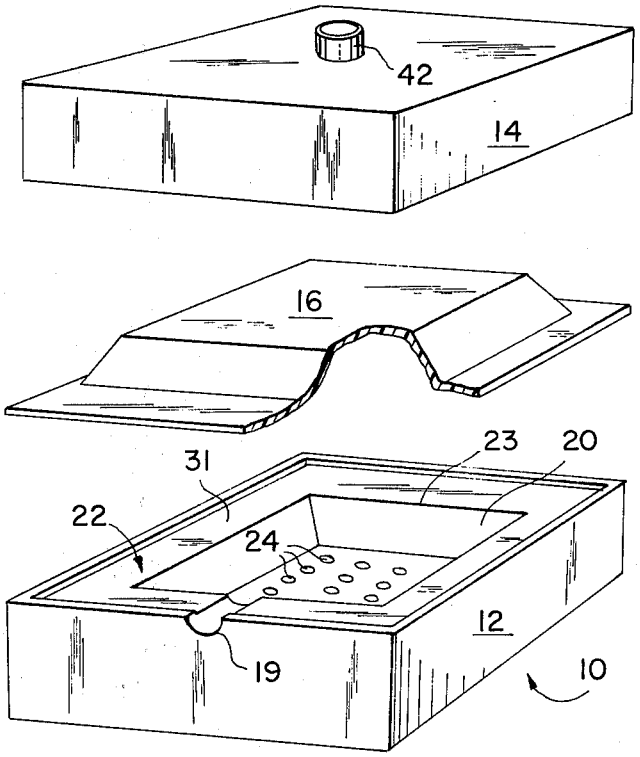
FIG. 1 is a perspective exploded view generally illustrating a preferred embodiment of the present packaging apparatus, part of one web layer work piece being shown as it may appear when in received position, with a portion thereof removed for greater clarity.
Figure 2:
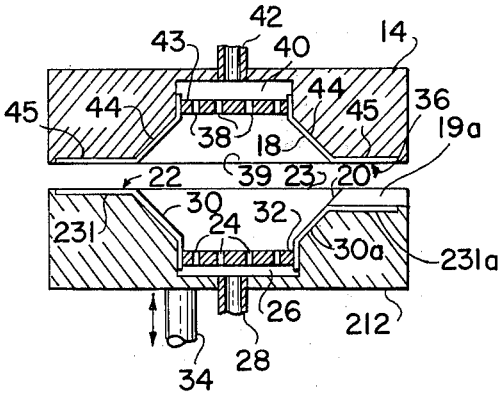
FIG. 2 is a section taken transversely of the apparatus of FIG. 1, illustrating the molds in packaging register and a passageway between the molds for reducing pressure in the packaging cavity.

Referring to the drawing FIG. 1 illustrates, in exploded perspective view, apparatus 10 including first mold 12 and second mold 14, which as shown may appear as lower and upper molds, respectively, the apparatus appearing with web layer 16 shown in downwardly concave shape as it may appear when received in substantially conforming relation with downwardly open cavity defining wall 18 (FIG. 2) of the upper mold. A recess disposed transversely of a mold lip may be provided in at least one of the molds, as illustrated by recess 19 in lip 22 of mold 12. The transverse recess is a suitable means whereby the pressure may be reduced in a packaging cavity provided in part by mold 12 in operation of the apparatus. FIG. 2 illustrates the apparatus in transverse section taken axially of recess 19 with the molds in substantial cavity-to-cavity register for packaging, mold 212 (subsequently described herein), being selected as the lower mold for illustration. Except where otherwise indicated below, mold 12 and mold 212 are substantially the same.

Mold 12 includes inner wall 20 defining a generally concave open cavity and terminating to lip 22 disposed peripherally about the opening or mouth 23 of the cavity, the wall being adapted to receive a layer of flexible web material. The cavity wall may include a generally flat inner portion with a tapering side portion extending outwardly therefrom and terminating to the lip. The mold includes means for releasably receiving an inner portion of a web layer against the wall in generally wall-conforming shape, preferably substantially throughout the cavity-defining surface thereof, and for releasing the received web layer. The receiving and releasing means may be a reversibly operable differential gas pressure system including holes 24 extending through the wall and communicating with plenum 26, which in turn communicates with conduit 28 adapted by suitable means not shown for selective connection with pressure reducing and pressure applying means which may be vacuum pump and the atmosphere, respectively. As described in greater detail below, appropriate pressure reduction aids in receiving inner portions of web layers and appropriate pressure application effects web layer release.

The means for releasably receiving the relatively outer portion of the web layer may include any suitable recess system disposed in the lip and in flow communication with a pressure reducing means, which may be, for example, a vacuum pump not shown. A preferred lip recess system is shallow L-shape recess 31, shown in FIG. 1, opening on the base of the recess to the tapering side portion of wall 20 for flow communication along the wall with holes 24 of the above-described differential pressure system.

Another preferred lip recess system is shallow generally U-shaped recess 131 shown in mold 112 of FIG. 8 and FIG. 9, which mold may be substantially of the same structure as mold 12 unless described otherwise herein. Mold 112 is provided with spaced apart passages 132 therethrough which are connected at ends thereof with generally rectangular recess 131 and at opposite ends thereof with conduit 134 which may be operably connected to a source of vacuum, for example a vacuum pump not shown. Conduit 134 may include vent 136 provided with valve 138 for repressuring recess 132 to aid in release of an outer web portion after a package has been formed in the apparatus. Where a transverse recess such as recess 19*b* is provided in mold 112, the generally rectangular recess 131 preferably includes an arcuate portion 131*a* generally conforming to the transverse recess, as shown in FIG. 9, for aid in effectively forming a passage between a web layer portion received by lip 122 and a corresponding outer portion of another web layer.

Still another preferred lip recess system includes a plurality of shallow recesses 231 shown in mold 212 (FIG. 10 and FIG. 11), which may be of substantially the same structure as mold 12 except as otherwise described herein. Mold 212 further includes a plurality of recesses 30 disposed in wall 20, these recesses communicating with plenum 26 and lip recesses 231, whereby the above-described differential pressure system which is operative for receiving and releasing an inner portion of a web layer against wall 20 communicates with and in part constitutes a part of the means for releasably receiving the outer portion of the web layer against the lip, that is plenum 26 and conduit 28 are common to the differential pressure system associated with the lip and the differential pressure system associated with the wall. Where one or more transverse recesses such as recess 19 are provided in mold 212, they may be provided intermediate recesses 231 or coaxial therewith as illustrated in FIG. 10 and FIG. 11 by arcuate recess 231*a* which is generally parallel with the surface of transverse recess 19*a*. As used herein, letter suffixes, e.g., *a*, are used in conjunction with element identifying numerals, e.g., 19, to identify particular elements generally like other elements identified by the same numeral.

Heater 32, shown included in wall 20, is desirably provided for heating the inner surface of the cavity for softening of thermoplastic web layers, with which skin packages may be prepared by the present invention.

Mold 14 includes inner wall 18 defining a generally concave open cavity and terminating to lip 36 disposed peripherally about the opening or mouth 39 of the cavity, the wall being adapted to receive a layer of flexible web material. The cavity wall may include a generally flat inner portion with a tapering side portion extending outwardly therefrom and terminating to the lip. The mold includes means for releasably receiving an inner portion of a web layer against the wall in generally wall-conforming shape, preferably substantially throughout the cavity-defining surface thereof, and for releasing the received web layer. The receiving and releasing means may be a reversibly operably differential gas pressure system including holes 38 extending through the wall and communicating with plenum 40, which in turn communicates with conduit 42 adapted by suitable means not shown for selective connection with pressure reducing and pressure applying means which may be a vacuum pump and the atmosphere, respectively.

The means associated with mold 14 for releasably receiving the relatively outer portion of the web layer may include any suitable recess system disposed in the lip and in flow communication with a pressure reducing means, which may be for example, a vacuum pump not shown. Any of the various types of releasably receiving means described above with reference to lower molds 12, 112, and 212 may be provided in the upper mold. Mold 14 is illustrated as having a plurality of lip recesses 45, each communicating with one of a plurality of wall recesses 44 disposed in wall 18, the wall recesses communicating with plenum 40, whereby the above described differential pressure system which is operative for receiving and releasing an inner portion of a web layer against the wall 18 communicates with and in part constitutes a part of the means for releasably receiving the outer portion of the web layer against lip 36, that is plenum 40 and conduit 42 are common to the differential pressure system associated with lip 36 and the differential pressure system associated with wall 18. Lip 36 may have a transverse recess, e.g., that illustrated by recess 19*a*, disposed therein, or it may be generally flat throughout as shown.

Heater 43, shown included in wall 18, is desirably provided for heating the inner surface of the cavity for softening of thermoplastic web layers, with which skin packages may be prepared by the present invention.

The heaters schematically shown as elements 32 and 43 may be for example, any suitable platens heated by any suitable heating medium, including steam, electric resistance elements and the like. Heater 32, for example, is shown in greater detail in FIG. 13. The means for heating the platen heater there illustrated is steam conduit 82 disposed generally adjacent and intermediate holes 24. The steam enters through inlet 84 and exits through outlet 86. Alternatively the conduit may carry an electric resistance heating wire or the like, with electric leads disposed through the inlet and outlet. The inlets and outlets of the heaters may be connected to a source and sink of steam or electric energy by means of suitable conduits which may extend through mold openings 42 and 28 or other suitable openings may be provided, as desired.

The cavity walls and lips preferably include a release coating which may be, for example, of any suitable fluorocarbon polymeric composition such as tetrafluoroethylene polymers, fluorinated ethylene-propylene resins, and the like. Suitable fluorocarbon coating compositions are available from E. I. duPont under the trademark Teflon. Release coatings are found to aid in performance of the inner and outer web portion release functions of the various release means described above.

Mold 212 may include recess 19*a* in lip 22 defining a passageway means extending substantially from the mouth of the packaging cavity to an external surface of the mold, that is from an inner end of the lip to an outer end of the lip. When the molds are in register as in FIG. 2 the arcuate surface of recess 19*a* is spaced apart from the corresponding portion of lip 36 in the upper mold at a sufficient distance to receive the upper and lower web layers therebetween with a resulting passageway providing for communication of the packaging cavity with peripheral portions of the web layers proximate the outer ends of the lips in the passage region. The outer port of this passage may be connected with a pressure reducing means for removing air or other gaseous composition from within the cavity. A suitable means for reducing the pressure within the cavity is open face chamber 72 having conduit 74*b* extending through the chamber wall for flow communication of chamber cavity 76 with an evacuation source which may be a vacuum pump not shown. The chamber is adapted to form a hermetic seal with the exterior of the apparatus about the passageway partially defined by recess 19*a*. A suitable seal may be effected by providing the open chamber face with resilient seal ring 78 of neoprene or the like and moving the chamber against the registered molds with application of sufficient pressure to sealingly engage the ring with the molds. The chamber may be moved by rod 80 connected thereto and reciprocably driven by any suitable means, for example a stroking cylinder not shown.

Any suitable means may be used for effecting packaging register of the mold cavities. A suitable means is schematically illustrated by reciprocably movable support 34 disposed below and secured to the mold 212.

The present process, in embodiments thereof, may be performed by operating the apparatus as described below.

Figure 3:
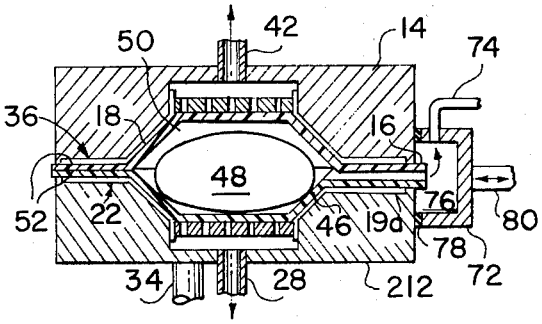
FIG. 3 is a section similar to FIG. 2 showing inner and outer portions of a web layer received in each mold.

In operation inner portions of initially flexible web layers 16 and 46 are received in substantially conforming relation with concave surfaces as may be provided by walls 18 and 20. Portions of the layers disposed outwardly of the inner portions are received into substantially conforming relation with lips such as lip surfaces 22 and 36 disposed peripherally of the two concave surfaces. Receiving of the web layers may be effected by initially disposing the layers in generally flat relation adjacent the mold lips and thereafter drawing the layers into substantially conforming relation with the mold cavities to appear, for example, as shown in FIG. 3 and FIG. 4. Drawing may be effected by applying differential gas pressure across a thickness of each web layer as by operatively connecting the conduits 28 and 42 to the suction port of a vacuum pump. Where it is desired to stretch the web layers about an article to be packaged, as may be necessary depending on the article size and shape, thermoplastic film may be used as the packaging material at or above the film softening temperature. The softening temperature of the film may be attained and maintained as by means of heaters 32 and 43. Application of differential pressure may be aided by pressurizing with air or other suitable gaseous composition admitted into the cavity through the passageway provided by recess 19*a*. After the web layers are received in substantially conforming relation with their respective concave surfaces, an article to be packaged may be placed on the substantially concave surface of at least one of the received web layers, as illustrated by article 48 in FIG. 3 and FIG. 4

Thereafter the cavities are brought into substantial packaging register, thereby registering the upper and lower web layers in packaging relation and providing a substantially enclosed third or packaging cavity 50. When in packaging register, at least portions of the received outwardly disposed web portions are spaced apart to define a passageway means extending from the packaging cavity to a periphery of the web layers, as shown in FIG. 3 generally about recess 19*a*. Thereafter, while maintaining the web layers in mold received relation the pressure within the packaging cavity may be reduced substantially throughout by removing gaseous composition, e.g. air, through the passageway means. As the passageway means is provided by suitable spaced-apart relation of the lips in packaging register position, the present apparatus does not require channels or the like extending through either mold for reducing pressure in the packaging cavity. Conveniently, the passageway means may be provided using molds with lips not having or requiring recesses therein and registering the molds with the lips spaced apart to provide passageway means extending substantially about the openings of the first and second mold cavities. In apparatus illustrated by apparatus 10, the first and second lips are cooperable in register position for substantially hermetically sealing flange portions 52 of the web layers between corresponding regions of the lips while the passageway is provided by other corresponding lip regions including and proximate to recess 19*a*.

After the pressure is reduced in the packaging cavity, the received web layers are released from the molds to collapse portions of the layers into substantially conforming relation with the article, or at least an overall periphery thereof, and to collapse second portions of the layers into layer-to layer engagement peripherally of the article and the engaged web portions are bonded to form a substantially hermetically sealed article.

In FIG. 3 the arrows associated with ports 42 and 28 illustrate the exhaustion of air from manifolds 26 and 40 where the web layers are drawn into concave conformity with the molds as described above. In FIG. 5 the resulting packaged article is illustrated with web layers 16 and 46 substantially conforming about a periphery of article 48, the arrows directed inwardly through ports 28 and 42 illustrating admission of the atmosphere or any suitable gaseous composition at a pressure above the reduced pressure in the package interior for effecting the illustrated collapsed arrangement of the webs about the article.

FIG. 7 illustrates the package after removal from the molds which have been opened to permit such removal with minimal excess film trimmed as desired. Any suitable combination of pressures may be used in the various pressure reduction steps of the present process. For aid in improving the package properties, it is generally desired that the reduced pressure within the packaging cavity be a vacuum of at least 20 inches Hg (about 5 p.s.i.a.) and preferably at least about 29 inches Hg. When releasing the received web layers for collapse about the article the pressure applied to the outer surfaces of the web layers exceeds the reduced pressure in the package, desirably by at least one or two and preferably 5 to 25 inches of Hg.

FIG. 6 illustrates in perspective view a mold component 60 of an embodiment of the present apparatus. Mold 60, which may otherwise be generally similar to molds 12 and 14, includes a polygonal lip 62 shown of generally rectangular shape and having opposite sides with lip regions 64 and 66 recessed below the lip regions 68 and 70 of mold ends interconnecting the opposite sides. In combination with a second cooperating mold such as mold 14 having a generally flat lip throughout the periphery of the cavity mouth, lip portions 68 and 70 cooperate in packaging register position with corresponding lip regions of the second mold for substantially hermetically sealing flange portions of first and second web layers received in the molds, and lip regions 64 and 66 cooperate with corresponding regions of the lip of the second mold to provide passage means through which gaseous composition in the packaging cavity may be removed. Each of recesses 64 and 66 may include open ends of holes 67 which extend through the mold and communicate with conduit manifold 69 for selectively reducing and applying pressure through the holes to releasably receive and release outer portions of a web layer against and from the recesses.

The web layers may be of any suitable packaging material including but not limited to thermoplastics such as polyethylene, cross-linked polyethylene, polypropylene, saran, ethylene vinyl alcohol copolymers, nylon, polyvinyl chloride and the like and laminates thereof. If desired the web layers may be heated prior to being received into substantially conforming relation with the mold cavities. Preferably the film layers are of impervious material that is, having relatively low permeability to gaseous compositions, especially air and oxygen. Composite laminates each including a lamina of a polymeric composition including a substantial portion of addition reacted vinylidene chloride units are specially suitable. Desirably, prior to collapsing the web layers there is relatively little clearance between the article and the received web layers, as results by suitable selection of dimensions of articles to be packaged and the mold cavities. Use of such small clearance is found to further improve uniformity of stretching and further minimize thinning and weakening of the collapsed films in the packaged products prepared by the present invention.

A highly suitable web layer for use herein is a polyethylene layer having a coating thereon of an effectively sealable coating material, preferably an ethylene vinyl acetate interpolymer, the coating being provided on the sides of the layers disposed facing the packaging cavity interior. Upon collapse of the layers, the ethylene-vinyl acetate interpolymer coatings interengage and readily bond to effect hermetic sealing of the engaged film layers. Suitable bonding materials include pressure sensitive adhesives and heat activatable adhesives which will bond the engaged layers under the pressure and temperature conditions in the packaging cavity. If desired the packaging cavity may be blanketed with inert gases, e.g., nitrogen, the same being especially suitable in packaging air or oxygen sensitive materials such as meat, poultry, fish and other food products.

Herein collapse of the web layers is preferably effected progressively outwardly from a region of the article disposed relatively distant from the outer portions of each web layer. Such improved collapsing may be further improved, for example, by applying higher collapsing pressure to central regions of the web layers relative to the pressure applied outwardly thereof. Thus, for collapsing the layers using differential air pressure in the present apparatus, e.g., that illustrated in FIG. 1 by apparatus 10, the holes disposed through central regions of the cavity-defining walls may be of maximum diameter with the holes progressively outward therefrom being formed of progressively smaller diameter. Conveniently the apparatus may be formed for suitable progressively outward collapse by providing the molds with baffles of any suitable shape, e.g., generally conical shape, as in the mold plenums.

Web layers suitable for use in the present invention include, but are not limited to, non-joined layers of webs and the two layers resulting from longitudinally folding a single web as, for example, about a center line thereof.

It is to be understood that the foregoing detailed description is given merely by way of illustration and numerous variations may be made therein without departing from the spirit or scope of the present invention.

I claim:

1. An apparatus for vacuum skin packaging an article between two flexible web layers, comprising a. a first mold having a first inner wall defining a first generally concave open cavity, said first wall terminating to a first lip disposed peripherally about the opening of said first cavity, said first wall adapted to receive an inner portion of a first layer of flexible web material;

b. means for releasably receiving the inner portion of the first web layer adjacent the first wall in generally wall-conforming shape substantially throughout the cavity-defining surface thereof and for releasing the received inner portion of said first web layer;

c. a second mold having a second inner wall defining a second generally concave open cavity, said second wall terminating to a second lip disposed peripherally about the opening of said second cavity, said second wall adapted to receive an inner portion of a second layer of flexible web material;

d. means for releasably receiving the inner portion of the second web layer adjacent the second wall in generally wall-conforming shape substantially throughout the cavity-defining surface thereof and for releasing the received inner portion of the second web layer;

e. differential fluid pressure means disposed in said first lip for releasably receiving a relatively outer portion of the first web layer against the first lip;

f. differential fluid pressure means disposed in said second lip for releasably receiving a relatively outer portion of the second web layer against the second lip;

g. means for substantially registering the molds to provide a partially enclosed third cavity for forming a package; and h. means for reducing pressure substantially throughout said third cavity by removing gaseous composition therefrom through a passageway means provided by spaced apart portions of said first and second lips when the molds are in register, said passageway means extending from inner ends of said lips to outer ends of said lips, at least one of said inner walls adapted to support an article to be packaged and placed on a web layer received adjacent said at least one inner wall.

2. The apparatus of claim 1 wherein said passageway means extends substantially about the openings of said first and second cavities.

3. The apparatus of claim 1 wherein said first and second lips are cooperable in register position for substantially hermetically sealing flange portions of first and second web layers between first corresponding regions of said lips and said passageway means is provided by second corresponding regions of said lips.

4. The apparatus of claim 3 wherein said cavity openings are generally polygonal and the passageway means includes passages terminating to a pair of generally opposite sides of the polygon.

5. The apparatus of claim 3 wherein said passageway means includes a recess in at least one of said lips.

6. The apparatus of claim 1 wherein the receiving and releasing means of clauses (b) and (d) each include means for developing differential fluid pressure across the inner portion of the corresponding web layer.

7. The apparatus of claim 6 wherein the differential pressure means for releasably receiving the relatively outer portion of the first web layer communicates with the differential pressure receiving and releasing means associated with the first cavity and the differential pressure means for releasably receiving the relatively outer portion of the second web layer communicates with the differential pressure receiving and releasing means associated with the second cavity.

8. The apparatus of claim 1 wherein each mold further includes means for heating at least the inner walls defining the first and second cavities.

9. A process for vacuum skin packaging an article between two flexible web layers, comprising A. providing a first layer of flexible web material having a first substantially concave-shape inner portion with a peripheral portion of said first layer disposed outwardly of said first inner portion;

B. providing a second layer of flexible web material having a second substantially concave-shape inner portion with a peripheral portion of said second layer disposed outwardly of said second inner portion;

each layer of web material adapted to bond to the other layer of form a hermetic seal;

C. placing the article on the substantially concave portion of at least one of said web layers;

D. registering said concave-shape web layers to provide a partially enclosed packaging cavity about the article with at least a portion of the outwardly disposed portion of one of the web layers spaced from the other web layer and establishing differential fluid pressure across at least one of said peripheral portions to define a passageway means extending from the cavity to a periphery of at least one of the web layers;

E. while maintaining the web layers in registered relation, removing a sufficient portion of gaseous composition from the packaging cavity through the passageway means to reduce the gas pressure in the cavity to below atmospheric pressure;

F. while the pressure in the packaging cavity is reduced, moving the web layers to collapse first portions of the layers into substantially conforming relation with the overall periphery of the article and to collapse second portions of the layers into layer-to-layer engagement peripherally of the article; and G. bonding said engaged web portions to form a hermetically sealed packaged article.

10. The process of claim 9 wherein said layers of web material have low permeability to gaseous compositions.

11. A process for vacuum skin packaging an article between two flexible web layers, comprising A. receiving an inner portion of a first layer of flexible web material into substantially conforming relation with a first concave surface and receiving a peripheral portion of said layer disposed outwardly of said inner portion into substantially conforming relation with a first lip surface disposed peripherally of said first concave surface;

B. receiving an inner portion of a second layer of flexible web material into substantially conforming relation with a second concave surface and receiving a peripheral portion of said second layer disposed outwardly of said inner portion into substantially conforming relation with a second lip surface disposed peripherally of said second concave surface;

each layer of web material adapted to bond to the other layer to form a hermetic seal;

C. placing the article on the substantially concave surface of at least one of said received web layers;

D. registering the received web layers to provide a partially enclosed packaging cavity about the article with at least portions of the received outwardly disposed web portions being spaced apart and establishing differential fluid pressure across at least one of said peripheral portions to define a passageway means extending from the cavity to a periphery of at least one of the webs;

E. while maintaining the web layers in registered relation removing a sufficient portion of gaseous composition from the packaging cavity through the passageway means to reduce the gas pressure in the cavity to below atmospheric pressure;

F. while the pressure in the packaging cavity is reduced, releasing the received web layers to collapse first portions of the layers into substantially conforming relation with the overall periphery of the article and to collapse second portions of the layers into layer-to-layer engagement peripherally of the article; and G. bonding said engaged web portions to form a hermetically sealed packaged article.

12. The process of claim 11 wherein said layers of web material have low permeability to gaseous compositions.

13. The process of claim 11 wherein the passageway means includes corresponding spaced apart portions of each drawn web layer extending at least to the outer peripheries of the lip surfaces.

14. The process of claim 11 wherein the web layers are of thermoplastic composition and the layers are collapsed while the inner layer portions are heat softened and formable.

15. The process of claim 14 wherein the layers of thermoplastic composition are composite laminates each including a lamina of a polymeric composition including a substantial portion of polymerized units selected from the group consisting of vinylidene chloride and ethylene vinyl alcohol.

16. The process of claim 14 wherein the layers of thermoplastic composition are of polyethylene coated with an ethylene vinyl acetate interpolymer.

17. The process of claim 11 wherein prior to collapsing the web layers there is relatively little clearance between the article and the received web layers.

18. The process of claim 11 wherein the concave surfaces are substantially of the same depth and the sealed web-to-web peripheral portion of the package is formed substantially equatorially about the article.

19. The process of claim 11 wherein said collapse of each layer portion into substantially conforming relation with the article is effected progressively outwardly from a region of the article disposed relatively distant from the substantially lip-conforming portion of the web.

20. An apparatus for vacuum skin packaging an article between two flexible web layers, comprising a. a first mold having a first inner wall defining a first generally concave open cavity, said first wall terminating to a first lip disposed peripherally about the opening of said first cavity, said first wall adapted to receive an inner portion of a first layer of flexible web material;

b. means for releasably receiving the inner portion of the first web layer adjacent the first wall in generally wall-conforming shape substantially throughout the cavity-defining surface thereof and for releasing the received inner portion of said first web layer;

c. a second mold having a second inner wall defining a second generally concave open cavity, said second wall terminating to a second lip disposed peripherally about the opening of said second cavity, said second wall adapted to receive an inner portion of a second layer of flexible web material;

d. means for releasably receiving the inner portion of the second web layer adjacent the second wall in generally wall-conforming shape substantially throughout the cavity-defining surface thereof and for releasing the received inner portion of the second web layer;

e. differential fluid pressure means for releasably receiving a relatively outer portion of the first web layer adjacent the first lip;

f. differential fluid pressure means for releasably receiving a relatively outer portion of the second web layer adjacent the second lip;

g. means for substantially registering the molds to provide a partially enclosed third cavity for forming a package; and h. means for reducing pressure substantially throughout said third cavity be removing gaseous composition therefrom through a passageway means provided by spaced apart portions of said first and second lips when the molds are in register, said passageway means extending from inner ends of said lips to outer ends of said lips, at least one of said inner walls adapted to support an article to be packaged and placed on a web layer received adjacent said at least one inner wall, wherein at least one of the differential fluid pressure means of clauses (e) and (f) includes a recess system disposed in its respective lip.

21. The apparatus of claim 20 wherein said passageway means is in flow communication with said recess system.

22. The apparatus of claim 20 wherein said recess system includes a L-shape recess opening on the base of the recess to the wall.

23. The apparatus of claim 20 wherein said recess system includes a closed loop U-shaped recess having a passage connected thereto for flow communication with a source of vacuum.

24. The apparatus of claim 20 wherein said recess system includes a plurality of shallow recesses in flow communication with a plurality of recesses disposed in the wall adjacent said respective lip.

* * * * *